United States Patent [19]

Switzer

[11] 4,166,939

[45] Sep. 4, 1979

[54] IMPULSE ACTUATOR UNIT FOR SWITCHES

[76] Inventor: William K. Switzer, 5703 Sprucewood Dr., Cincinnati, Ohio 45239

[21] Appl. No.: 915,795

[22] Filed: Jun. 15, 1978

[51] Int. Cl.[2] ..... H01H 13/56

[52] U.S. Cl. ..... 200/160; 200/332; 192/84 PM; 251/65; 403/DIG. 1

[58] Field of Search ..... 200/329–332, 200/323, 325, 34, 82 C, 160; 251/65, 318, 319, 39 R, 130; 403/DIG. 1; 192/84 PM; 261/DIG. 9, DIG. 54

[56] References Cited

U.S. PATENT DOCUMENTS

| | | | |
|---|---|---|---|
| 2,623,256 | 12/1952 | Feibelman | 403/DIG. 1 |
| 2,658,979 | 11/1953 | Jungholm | 200/331 |
| 2,904,661 | 9/1959 | Roeser | 200/160 |
| 3,212,751 | 10/1965 | Hassa | 251/65 |
| 3,261,958 | 7/1966 | Bittner | 200/160 |

*Primary Examiner*—Houston S. Bell, Jr.

[57] ABSTRACT

The present disclosure relates to a magnetically operated impulse actuator unit susceptible of assembly with a variety of conventional pneumatic limit valves or electric limit switches to respectively secure an impulse of fluid or an electric charge in the systems monitored by such valves or switches.

6 Claims, 4 Drawing Figures

IMPULSE ACTUATOR UNIT FOR SWITCHES

This invention relates to improvements in impulse actuators and is particularly concerned with a magnetically operated impulse actuator unit for switches.

An object of the invention is to provide a push button operated, actuator unit susceptible of assembly with a variety of conventional pneumatic limit valves or electric limit switches to respectively secure an impulse of fluid or an electric charge in systems controlled by such valves or switches.

Another object of the invention is to provide an actuator unit having the foregoing characteristics that may be maintained in switch actuated position after an impulse of fluid or electric charge has been produced in the systems controlled by the switches.

A further object of the invention is to provide a structurally simplified, low cost, yet rugged magnetically operated impulse producing actuator unit which is removed from and therefore unaffected by impurities in the switches which it monitors.

A still further object of the invention is to provide a push button, magnetically operated pulse actuator that will, when operatively depressed, provide a pulse of fluid or electricity in switch controlled systems even though the push button is mainteined in depressed condition; no tripping or other signal being required to return said button to its inoperative condition.

Another object of the invention is to provide a push button operated, actuator unit for switches wherein the impulse time produced by the unit in the switches may be controlled by the throw of an operating lever, or the like, associated with the push button.

Other objects and advantages of the present invention will become apparent from the following specification read in conjunction with the accompanying drawings, wherein.

Figure 1:
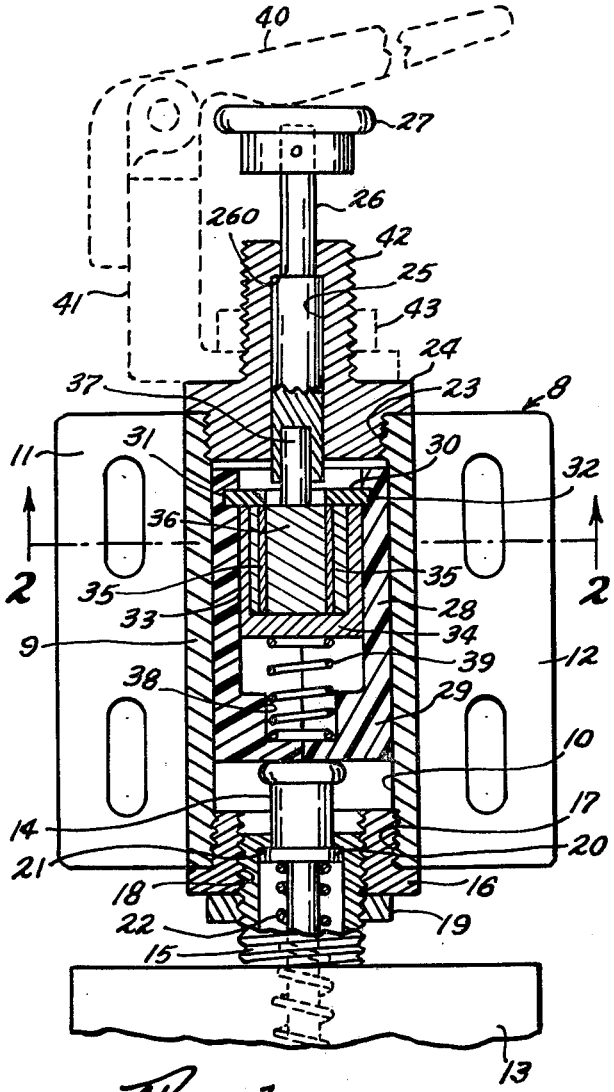
FIG. 1 is a longitudinal section through the impulse actuator unit, the associated switch being shown in elevation and other parts shown in dotted lines.
Figure 2:
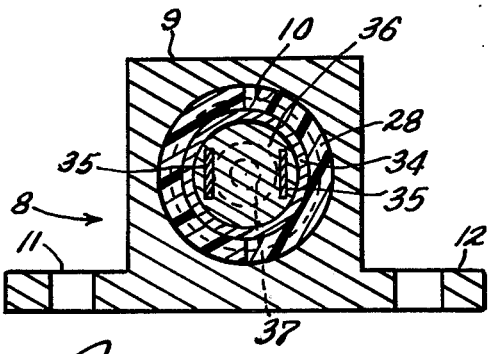
FIG. 2 is a section taken on line 2—2 of FIG. 1.

Referring particularly to FIGS. 1 and 2 of the drawings the present impulse actuator unit 8 has a housing 9 provided with a cylindrical bore 10 and with oppositely projecting adjustable mounting ears 11 and 12. The actuator unit 8 is adapted to be associated with and operate conventional switches 13 such as fluid limit valves, electric limit switches, or the like. These switches each have a spring pressed operating plunger 14 axially moveable in an externally threaded nipple 15, the switch being connected to the actuator unit housing by an externally threaded fitting 16 cooperating with the internal threads 17 formed in an open end of the housing 9, said fitting having internal threads 18 engaging the external threads 15 on the nipple. A lock nut 19 locks the switch 13 to the actuator unit 8. The plunger 14 has a shoulder 20 which is biased against an internal stop 21 in the nipple preferably by means of an expansile coil spring 22.

The opposed open end of the housing has internal threads 23 which engage a threaded fitting 24, said fitting having a two-diameter bore 25 formed therethrough in axial alignment with the cylindrical bore 10 in the housing 9. A two-diameter, non-magnetic push rod 26 has a sliding fit in the bore 25 and has an operating knob 27 secured on the extremity of its reduced extended portion. The two-diameter bore 25 and the two-diameter rod 26 form a stop means 260 determining the inoperative position of the unit parts.

Mounted within the housing is a free floating piston 28 having a plastic, two-piece blind end construction, the blind end 29 of the piston being continuously engaged by the spring pressed operating plunger 14 of the switch 13. The open end of the piston mounts a ring member 30 made of ferromagnetic material, said ring member being held in semi-circular, confronting grooves 31 and 32 formed in the two-piece piston 28. The ring has an opening therethrough which permits the push rod 26 to freely pass through.

The piston contains a permanent magnet assembly 33 that is axially slidable therein and is normally held against the ring 30 by magnetic flux. Preferably the magnetic assembly includes a cup 34 containing a plurality of pole oriented magnets 35 embedded in a ceramic material 36 filling the cup.

The inner end of the push rod 26 has projecting therefrom a resilient, urethane plastic push pin 37 which extends through the ring 30 and continuously engages against the permanent magnet 33. The blind end of the piston has a well 38 therein which seats an auxiliary light, expansile spring 39 having its free end in engagement with the cup 34 of the permanent magnet assembly 33.

As illustrated in dotted lines of FIG. 1 of the drawings the rate of axial movement of the operating push rod 26 of the unit may be regulated by means of a lever 40 of the second class pivotally mounted on a bracket 41 attached to the externally threaded neck 42 of the fitting 24 by means of a hold down nut 43. An intermediate part of the lever bears against the knob 27 and by utilizing the proper arm length of the lever the throw of the lever and hence the rate of movement of the push rod and the pulse time of the switch may be regulated. The said rate of movement is a product of the speed of actuation and the distance from the lever pivot at which the actuation force is applied.

Figure 3:
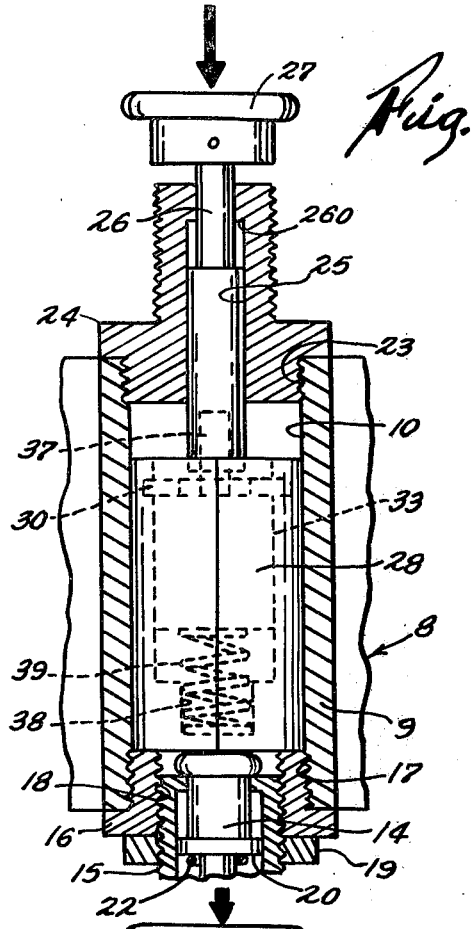
FIG. 3 is a longitudinal sectional view of the actuator unit, parts being shown in their pre-travel and pulse producing positions.
Figure 4:
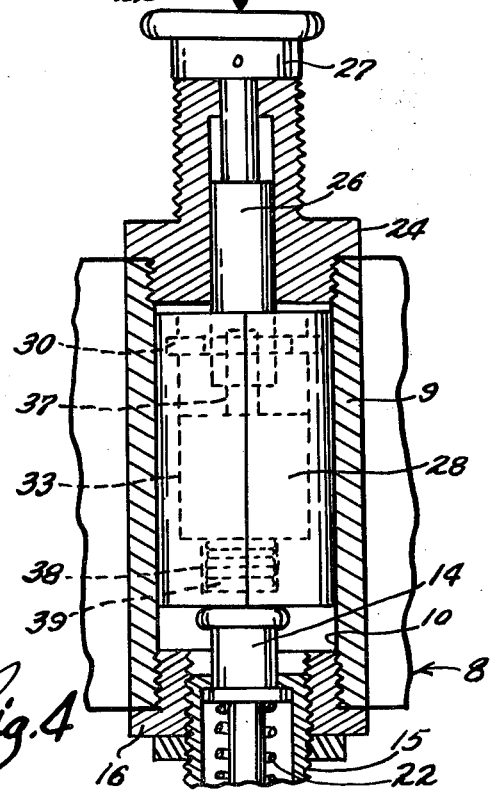
FIG. 4 is a longitudinal sectional view of the actuator unit; parts being shown in their breakaway positions after producing a pulse in the associated switch.

In operation the normal inoperative positions of the impulse actuator unit parts are depicted in FIG. 1 of the drawings wherein the plunger 14 is biased by spring 22 into one of its limits of motion with the shoulder 20 spring pressed against the stop 21. The plunger 14 is in engagement with the blind end 29 of the piston 28 thereby maintaining the piston in its inoperative position within the cylindrical bore 10 of the housing 9. The operating push rod 26 in its inoperative position against the stop 260 engages the permanent magnet 33 and the magnetic flux between said magnet and the ring 30 detachably secures the magnet in inoperative position within the piston, it being understood that the flux attraction between the magnet and ring is greater than the bias of spring 22. Pretravel of the actuator unit is initiated by axial pressure on the knob 27 which moves the parts into the positions shown in FIG. 3 against the bias of the spring 22; the second last phase of the travel being adapted to produce an impulse in the switch 13. As the push rod and knob move from said position to a position shown in FIG. 4, the plunger being stopped against the top of the nipple 15 and/or the piston 28 being stopped against the fitting 16, the magnetic flux between the permanent magnet and ring is overcome and the piston breaks away from the stem depressed magnet thus permitting the plunger 14, under the influence of the spring 22, to return to inoperative position and push the piston 28 to its inoperative position, regardless of how long the knob 27 and push rod 26 remain in their fully operative positions against the permanent magnet 33. Return of the knob and push rod to inoperative positions shown in FIG. 1 is accomplished without tripping or other signal by the attraction of the magnet and the ring upon release of downward pressure on the knob which in some instances may be aided by the spring 39.

What is claimed is:

1. In combination with a switch operated by a spring pressed axially moveable plunger having limited axial movement, a momentary impulse actuator unit for producing an impulse in said switch comprising a housing having a central bore in alignment with the plunger, a hollow free-floating piston reciprocal within the bore and normally disposed in inoperative condition at one end of the bore, said piston having one end in engagement with the plunger, a ferromagnetic member mounted in the opposite end of the piston, a permanent magnet assembly reciprocal within the piston and normally retained in said opposite end of the piston by the magnetic attraction to the member, an operating push rod mounted for reciprocating movement in the housing and having its inner end in engagement with the permanent magnet, the flux attraction between the magnet and the ring being greater than the spring pressed force of the plunger, and means for operating the push rod, whereby upon actuation of the push rod the piston moves the plunger through a pre-travel phase to a second last phase to momentarily operate the switch, continued movement of the push rod in the last phase forcing the piston to its limit of motion thereby overcoming the magnetic attraction between the permanent magnet and the member to release the piston and allow the plunger under its biasing means to return itself and the piston to their normal conditions.

2. The combination set forth in claim 1 wherein the ferromagnetic member is a ring and the operating push rod freely extends through the ring to engage the permanent magnet.

3. The combination set forth in claim 2 wherein the piston has a blind end in engagement with the plunger and is formed of two-pieces, each piece having a ring mounting groove formed in the open end of the piston.

4. The combination set forth in claim 2 wherein the push rod has a resilient plastic end that extends through the ring to engage the permanent magnet.

5. The combination set forth in claim 1 wherein an expansile return spring is disposed between the piston and the permanent magnet.

6. The combination set forth in claim 1 wherein the means for operating the push rod is a lever of the second class.

* * * * *